US005134823A

United States Patent [19]

Laughon

[11] Patent Number: 5,134,823

[45] Date of Patent: Aug. 4, 1992

[54] TRIM STRIP APPARATUS FOR CONCEALING A JOINT

[75] Inventor: Thomas C. Laughon, Hickory, N.C.

[73] Assignee: McCalla/Lackey Corporation, Hickory, N.C.

[21] Appl. No.: 646,467

[22] Filed: Jan. 25, 1991

Related U.S. Application Data

[63] Continuation of Ser. No. 364,962, Jun. 12, 1989, abandoned.

[51] Int. Cl.[5] ..... E04C 2/38

[52] U.S. Cl. ..... 52/717.1; 52/718.1

[58] Field of Search ..... 52/465, 466, 281, 287, 52/469, 467, 211, 312, 718, 217, 716, 288

[56] References Cited

U.S. PATENT DOCUMENTS

| | | | |
|---|---|---|---|
| 1,900,769 | 3/1933 | Schemmel | 52/717 |
| 2,910,033 | 10/1959 | Weisburg | 52/717 X |
| 3,534,516 | 10/1970 | Cooper | 52/718 X |
| 4,656,805 | 4/1987 | Winkowski | 52/716 X |

*Primary Examiner*—David A. Scherbel
*Assistant Examiner*—Wynn E. Wood
*Attorney, Agent, or Firm*—Bailey & Hardaway

[57] ABSTRACT

A decorative trim strip apparatus for concealing a joint or crack comprising a longitudinally oriented channel defining a longitudinal opening in the center thereof, the channel being defined by parallel, opposed first and second sides and a longitudinal floor disposed opposite and parallel to the longitudinal opening of the channel, the first and second sides and the floor each having an inner surface, an outer surface, a first and a second end, the outer surface of the floor being adapted to cover the joint or crack, the trim strip apparatus further having an elongated trim strip which is detachably or totally mounted to the channel opposite and parallel to the longitudinal floor for movement between a first position enclosing the longitudinal opening and a second portion which does not enclose the longitudinal opening. The channel is positioned over a generally liner joint or crack and then attached to the surface in which the crack apparatus thereby concealing the joint or crack. The trim strip which may or may not be attached to the channel is then mounted to the channel to enclose the longitudinal channel opening.

6 Claims, 2 Drawing Sheets

TRIM STRIP APPARATUS FOR CONCEALING A JOINT

This application is a continuation of application Ser. No. 07/364,962, filed Jun. 12, 1989, now abandoned.

FIELD OF THE INVENTION

This invention relates to a multi-part decorative trim strip particularly adapted to cover a generally linear joint or crack.

BACKGROUND OF THE INVENTION

Decorative moldings and trim strips are commonly used on many wood and wood simulated surfaces to enhance the attractiveness, decorative value or the artistic effectiveness of finished surfaces of wood bodies and other surfaces simulating finished wood such as wood furniture or frames for holding pictures or documents for wall mounting. Typically, such moldings are fitted within a groove generally on a broad flat surface so that the molding will give the appearance of having been carved out of the original wood or simulated wood body.

Decorative moldings have also been applied to surfaces of various types of composite slabs such as wall panels and doors. Moldings of this type are disclosed in U.S. Pat. No. 4,706,431. Such molding is added to provide a decorative appearance to the visible surface of the composite material. Such moldings are also fitted into grooves formed in the composite slab which has a front surface of veneer laminated to a solid core. The molding has a base portion which fits into the groove and a flange portion which extends to each side of the base portion for overlapping and covering the veneer along the grooved upper edges. Through the use of this type molding, the exposed grooved edges can be blended in with the decorative molding without exposing any dissimilar door core material or chipped veneer portions along the grooved edges.

Decorative trim strips have also been used on the surfaces of desks, cabinets and other types of enclosures which serve as equipment housings for electronic devices to exhibit manufacturers or retailers trademarks, logos or names on a visible surface of such equipment. Such a trim strip is exemplified in U.S. Pat. No. 4,274,237. As resellers and alternate users transfer the equipment from one to the other, the trim strip exhibiting the prior name or logo is often removed and replaced with the name or logo of the new owner. To facilitate the simple removal of the old trim strip and reinsertion of the new trim strip, an elongated trim strip holder for receiving a removable trim strip has been used. The trim strip holder is attached to the surface of the equipment and a generally flat elongated flexible trim strip can be inserted within a channel on the surface of the trim strip holder. The trim strip is held in place by the edges thereof being received in recesses in the parallel walls of the channel and the bottom surface of the trim strip having contact with the upper surface of the ridge.

When wall paneling is placed edge to edge on a wall, a crack can be formed at the joint where the edges of the two sheets of paneling meet. In the mobile home business wherein walls are commonly constructed of sheets of wood paneling, such joints are generally covered by decorative trim strips which run the length of the joints. Typically, the trim strip is made of a solid material designed to match the appearance of the adjacent wood paneling. The strip is secured over the joint by staples or tacks. Such trim strips must be carefully matched to the surrounding paneling and care must also be given to avoid unsightly damage to the strip in the process of attaching it to the joint. Strips which are damaged during installation must be either repaired or replaced before the premises can be sold.

In the mobile home industry and mobile office trailer industry, such trim strips are applied as part of mass production of the mobile housing and office units. Since the removal or repair of such strips can add to the time and cost of production of the mobile units, the hereinafter described embodiments of this invention provide a trim strip apparatus which allows for quick installation of a trim strip and quick and easy reinstallation of any damaged trim strip.

SUMMARY OF THE INVENTION

In accordance with the subject invention, a trim strip apparatus for concealing a joint or crack is made of a longitudinally oriented channel defining a longitudinal opening in the center thereof. The channel is defined by parallel, opposed first and second sides and a longitudinal floor disposed opposite and parallel to the opening of the channel. The first and second sides and the floor each have an inner surface, an outer surface, a first and second end, the outer surface of the floor so as to fit flush against the joint. An elongated trim strip is detachably or totally mounted to the channel opposite and parallel to the floor for movement between a first position enclosing the longitudinal opening and a second position which does not enclose the longitudinal opening.

DETAILED DESCRIPTION

The trim strip apparatus of the subject invention can be used to conceal essentially linear joints created by the placement of panels of any material on generally flat surfaces including the wood paneling used in the mobile home and office industry. The preferred embodiments of the invention are shown in FIGS. 1-3.

Figure 1:
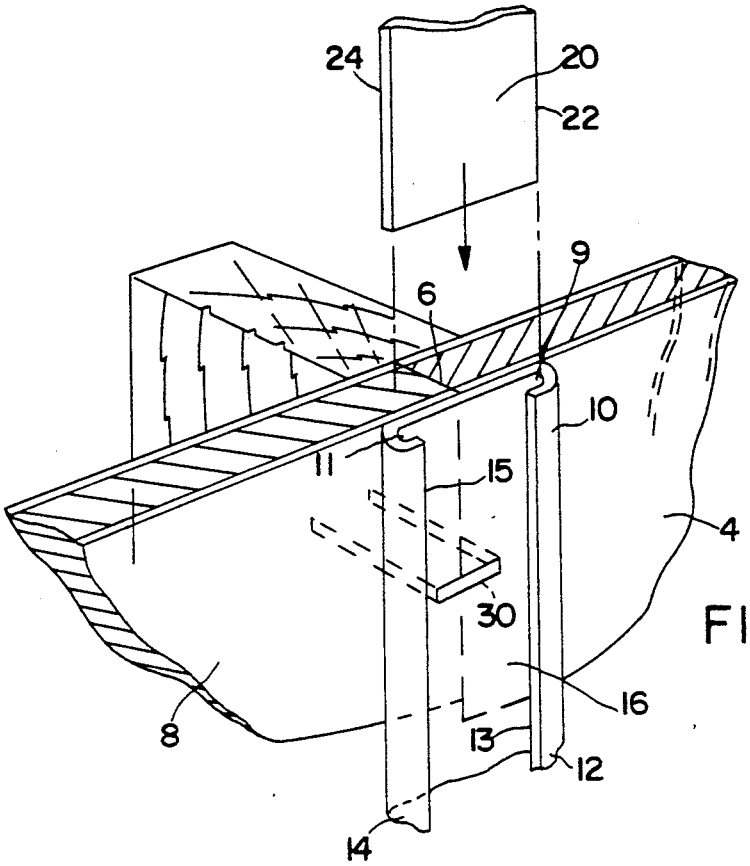
FIG. 1 is a perspective view of a trim strip apparatus having a longitudinal channel with a detachable trim strip for concealing a joint between two wall panels.

As shown in FIG. 1, a trim strip apparatus consists of 2 detachable parts, a channel 10 and a trim strip 20. The channel 10 is positioned over a joint 6 formed between wall panel 4 and wall panel 8. The channel 10 has a generally flat linear floor 16, the outer surface of which fits flush against the joint 6 as clearly illustrated in FIG. 1, and parallel opposed sides 12 and 14. The sides 12 and 14 of the channel 10 run parallel to the floor 16. The side 12 curves away from the floor 16 to an exposed edge 13 which partially overlaps the floor 16 thereby forming a recess 9. The side 14 is a mirror image of side 12 having an exposed edge 15 which partially overlaps an opposite area of the floor 16 thereby forming a recess 11. A staple 30 secures the channel over the joint 6.

The edge 22 of trim strip 20 may be fitted into recess 9 and the edge 24 of trim strip 20 may be fitted into recess 11 when the trim strip 20 is placed in the channel 10. When in place, trim strip 20 conceals staple 30 from view. The trim strip 20 may be inserted from an end of the channel 10, as shown in FIG. 1, or if trim strip 20 is sufficiently flexible, the edge 22 may be first inserted into recess 9 and then the trim strip 20 may be longitudinally bent along its length sufficiently to insert edge 24 into opposing recess 11.

Figure 2:
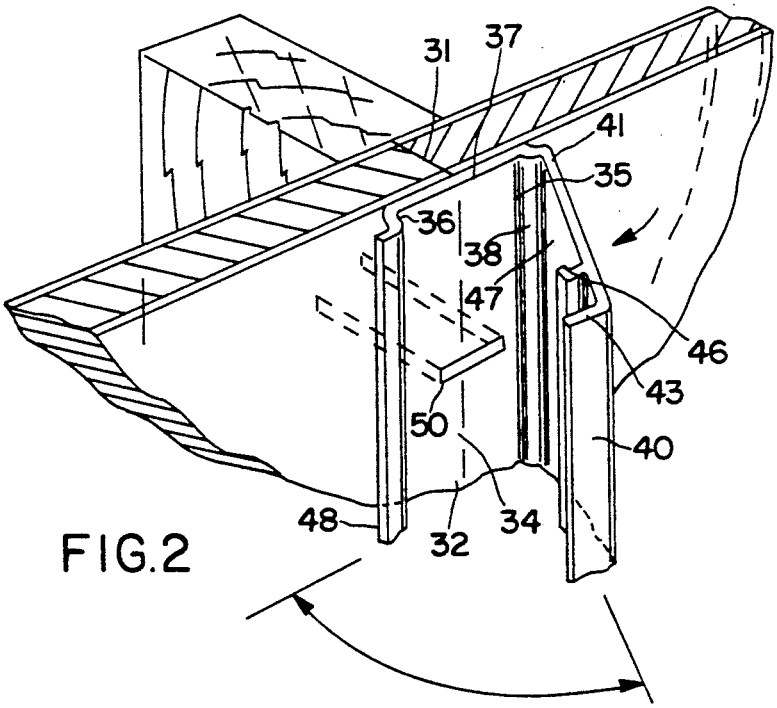
FIG. 2 is a perspective view of a trim strip apparatus for concealing a joint between two wall panels, having a channel with a living hinge on one side in cooperation with a channel cover rotatably attached to the hinge for opening and closing the opening of the channel.
Figure 3:
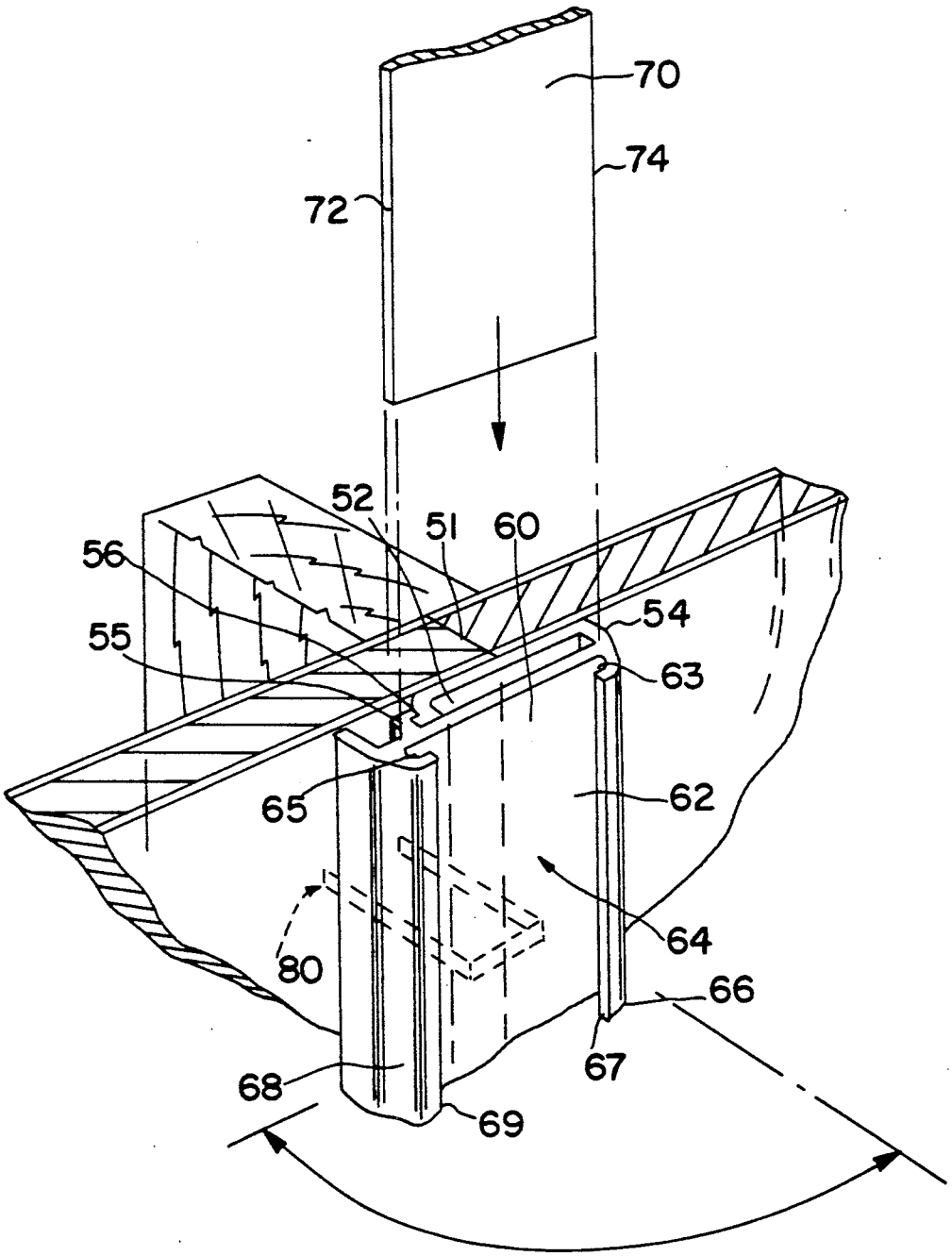
FIG. 3 is a perspective view of a trim strip apparatus as in FIG. 2 further having a second channel on the outer surface of the channel cover for receiving a detachable trim strip.

FIG. 2 illustrates another embodiment of the invention consisting of a channel 32 and a rotatably attached trim strip 40. The channel 32 is positioned over a typical joint 31 as in FIG. 1. The channel 32 has a generally flat linear floor 34, the outer surface of which fits flush against the joint 31 as clearly illustrated in FIG. 2, and parallel opposed sides consisting of side 36 and living hinge 38. The living hinge 38 runs the length of the channel 32 and connects edge 41 of the trim strip 40 to the edge 35 of the floor 34. An elongated latch 46 located between edges 41 and 43 of the trim strip 40 runs the length of trim strip 40 and parallel to edges 41 and 43. A latch strike 48 running the length of channel 32 protrudes outwardly from side 36 of channel 32. When the trim strip 40 rotates to the closed position, latch 46 makes contact with latch strike 48 and secures the trim strip 40 in the closed position. In the closed position, trim 40 conceals staple 50 from view.

FIG. 3 depicts a third embodiment of the invention and combines features of both FIGS. 1 and 2. In FIG. 3 a trim strip referred to as cover 60, is attached to a first channel 52 as in FIG. 2 and is shown in the closed position secured by a latch 55 and latch strike 56. As in FIGS. 1 and 2, the first channel is positioned over a typical joint 51 fitting flush against the joint 51, as clearly illustrated in FIG. 3, and the trim strip apparatus is fastened by staple 80. The cover 60 has been modified in FIG. 3 to contain features of the apparatus shown in FIG. 1. As shown in FIG. 3 a second channel 62 has a generally flat longitudinal floor 64 and parallel opposed sides 66 and 68. The sides 66 and 68 of the channel 62 run parallel to the floor 64. The side 66 curves away from floor 64 to an exposed edge 67 which partially overlaps floor 64 thereby forming recess 63. The side 68 is a mirror image of side 66 having an exposed edge 69 which partially overlaps an opposing area of floor 64 thereby forming a recess 65. The edge 74 of trim strip 70 is fitted into recess 63 and the edge 72 of trim strip 70 is fitted into recess 65 when the trim strip 70 is inserted in the channel 62. The trim strip 70 may be inserted from an end of channel 62 as shown in FIG. 3 or, if trim strip 70 is sufficiently flexible, edge 74 may be first inserted into recess 63 and then trim strip 70 may be longitudinally bent along its length sufficiently to insert edge 72 into opposing recess 65.

Three embodiments of a trim strip apparatus for concealing joints have been described above. These embodiments can be efficiently formed by extrusion or other suitable means. Although only three such embodiments have been shown and described, it will be understood that various changes in form and detail may be made without departing from the scope and spirit of the invention. Therefore, it is specifically understood that the disclosure provided herein is to be interpreted as illustration and not as a limitation.

That which is claimed:

1. A trim strip apparatus for concealing a joint, comprising:

a longitudinally oriented channel defining a longitudinal opening in the center thereof, the channel width being defined by parallel, opposed first and second sides, said first and second sides being webbed by a generally flat longitudinal floor disposed opposite and parallel to the opening, wherein the first side, the second side and the floor each have an inner surface, and outer surface, a first and second end, the outer surface of the floor fitting flush against the joint;

an elongated trim strip detachably mounted with said channel opposite and parallel to the floor for movement between a first position enclosing the longitudinal opening and a second position which does not enclose the longitudinal opening;

means for attaching the outer surface of the floor to cover the joint; and means for mounting the trim strip to the channel.

2. A trim strip apparatus for concealing a joint, comprising:

a longitudinally oriented channel defining a longitudinal opening in the center thereof, the opening of the channel being defined by parallel, opposed, first and second sides and a generally flat longitudinal floor disposed opposite and parallel to the opening, the width of the opening being less than the width of the channel along a longitudinal plane running parallel to the opening, each side and the floor having an inner surface and an outer surface, the outer surface of the floor fitting flush against the joint;

a generally flat elongated trim strip for receipt in said opening, the trim strip having an inner surface and an outer surface, a first edge and second edge, the distance between the first and second edges being greater than the width of the longitudinal opening and less than the width of the channel, the trim strip being detachable and slidably mounted between the opening and the floor for movement between a first position enclosing the longitudinal opening, and a second position which does not enclose the longitudinal opening, the trim strip being disposed parallel and opposite the opening; and means for attaching the outer surface of the floor to cover the joint.

means for mounting the trim strip within the channel.

3. A trim strip apparatus for concealing a joint, comprising:

a longitudinally oriented channel defining a longitudinal opening in the center thereof, the channel being defined by parallel, opposed first and second sides and a longitudinal floor disposed opposite and parallel to the opening, the first side, the second side and the floor each having an inner surface, an outer surface, a first and a second end, the outer surface of the floor fitting flush against the joint;

an elongated trim strip having an inner surface and an outer surface, a first edge and an outer second edge, the distance between the first and second edges being greater than the width of the longitudinal opening as well as the width of the channel, the first edge of the trim strip being rotatably attached to the first side of the channel for movement between a first position in which the channel is open and a second position in which the trim strip covers the channel and the inner surface of the trim strip contacts the second side of the channel along said outer second edge, the trim strip being disposed parallel and opposite the opening;

means for locking the trim strip in the second position to completely cover said channel; and means for attaching the outer surface of the floor to cover the joint.

4. A trim strip apparatus as in claim 1 wherein the means for attaching the floor of the channel to cover the joint is by stapling.

5. A trim strip apparatus as in claim 2 wherein the first and second sides of the channel comprise oppositely disposed arcuate members, each having a base edge secured to the floor of the channel and each having a top edge curving inwardly toward the opposite top edge, the distance between the top edge of both sides and the floor being equal and great enough to accept the trim strip.

6. A trim strip apparatus for concealing a joint, comprising:

a longitudinally oriented channel defining a longitudinal opening in the center thereof, the channel being defined by parallel, opposed first and second sides and a longitudinal floor disposed opposite and parallel to the opening, the first side, the second side and the floor each having an inner surface, an outer surface, a first and a second end, the outer surface of the floor being adapted to cover the joint;

an elongated trim strip having an inner surface and an outer surface, a first edge and an outer second edge, the distance between the first and second edges being greater than the width of the longitudinal opening as well as the width of the channel, the first edge of the trim strip being rotatably attached to the first side of the channel for movement between a first position in which the channel is open and a second position in which the trim strip covers the channel and the inner surface of the trim strip contacts the second side of the channel along said outer second edge, the trim strip being disposed parallel and opposite the opening;

means for locking the trim strip in the second position to completely cover said channel; and means for attaching the outer surface of the floor to cover the joint; and the trim strip defining a second longitudinally oriented channel on the outer surface thereof comprising;

a longitudinal opening in the center thereof, the second channel being defined by parallel, opposed first and second sides and longitudinal floor disposed opposed and parallel to the opening, the first side, the second side and the floor of the second channel each having an inner surface, an outer surface, a first and a second end;

an elongated trim strip slidably and detachably mounted to the second channel, opposite and parallel to the second channel floor for movement between a first position enclosing the second channel opening and a second position which does not enclose the second channel opening.

* * * * *